US009399897B2

(12) United States Patent
Stokes

(10) Patent No.: US 9,399,897 B2
(45) Date of Patent: Jul. 26, 2016

(54) ORIENTATION OF DOWNHOLE WELL TOOLS

(71) Applicant: HALLIBURTON ENERGY SERVICES, INC., Houston, TX (US)

(72) Inventor: Matthew B. Stokes, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 57 days.

(21) Appl. No.: 14/379,448

(22) PCT Filed: Oct. 31, 2013

(86) PCT No.: PCT/US2013/067839

§ 371 (c)(1),
(2) Date: Aug. 18, 2014

(87) PCT Pub. No.: WO2015/065448

PCT Pub. Date: May 7, 2015

(65) Prior Publication Data

US 2016/0010408 A1 Jan. 14, 2016

(51) Int. Cl.

| | |
|---|---|
| ***E21B 23/12*** | (2006.01) |
| ***E21B 43/119*** | (2006.01) |
| ***E21B 47/024*** | (2006.01) |

(52) U.S. Cl.

CPC ..... *E21B 23/002* (2013.01); *E21B 43/119* (2013.01); *E21B 47/024* (2013.01)

(58) Field of Classification Search

CPC . E21B 23/002; E21B 43/119; E21B 17/1057; E21B 47/024; E21B 7/061

USPC ..... 166/117.5, 255.2, 255.3, 313, 381, 382, 166/50, 53; 175/85, 79, 80, 82, 4.51

See application file for complete search history.

(56) References Cited

U.S. PATENT DOCUMENTS

| | | | | | |
|---|---|---|---|---|---|
| 2,120,670 | A * | 6/1938 | Hyer | E21B 47/024 | 166/255.3 |
| 2,691,507 | A * | 10/1954 | Brown | E21B 47/024 | 166/117.5 |
| 2,770,444 | A * | 11/1956 | Neal | E21B 7/061 | 166/177.5 |
| 2,953,350 | A * | 9/1960 | Moore | E21B 47/022 | 166/113 |
| 3,876,001 | A * | 4/1975 | Goode | E21B 23/03 | 166/117.5 |

(Continued)

FOREIGN PATENT DOCUMENTS

EP 00935049 A2 8/1999

OTHER PUBLICATIONS

Search Report and Written Opinion issued Jul. 24, 2014 for International Application No. PCT/US13/67839, 11 pages.

*Primary Examiner* — James G Sayre

(74) *Attorney, Agent, or Firm* — Chamberlain Hrdlicka

(57) ABSTRACT

A method of orienting a well tool can include setting down weight on an orienting device, thereby securing in position an engagement member that was previously free to displace circumferentially in the device, and after the securing, engaging the engagement member with an orienting profile. Another method of orienting a well tool can include compressing the orienting device between sections of a tool string, thereby securing in position an engagement member that was previously free to displace circumferentially in the device, the securing step including deforming a structure of the orienting device, and after the securing, engaging the engagement member with an orienting profile.

20 Claims, 6 Drawing Sheets

(56) References Cited

U.S. PATENT DOCUMENTS 4,094,360 A * 6/1978 Nelson ..... E21B 47/024 166/117.5
4,427,062 A * 1/1984 Tower ..... E21B 7/061 166/113
6,209,635 B1 4/2001 Gotlib et al.
6,510,898 B1 1/2003 Buytaert
7,886,842 B2 * 2/2011 Howard ..... E21B 43/119 166/255.2
2002/0162656 A1 11/2002 Dewey
2006/0191688 A1 8/2006 Murray
2008/0264639 A1 * 10/2008 Parrott ..... E21B 17/05 166/297

* cited by examiner

ORIENTATION OF DOWNHOLE WELL TOOLS

CROSS-REFERENCE TO RELATED APPLICATION

This application is a national stage under 35 USC 371 of International Application No. PCT/US13/67839, filed on 31 Oct. 2013. The entire disclosure of this prior application is incorporated herein by this reference.

TECHNICAL FIELD

This disclosure relates generally to equipment utilized and operations performed in conjunction with a subterranean well and, in one example described below, more particularly provides for orientation of downhole well tools.

BACKGROUND

It is at times beneficial to be able to rotationally or azimuthally orient a well tool in a well. For example, it may be desired to shoot perforating charges of a perforating gun in a particular direction, or it may be desired to drill a branch wellbore or deflect a completion assembly in a particular direction, etc.

Thus, it will be appreciated that improvements are continually needed in the art of orienting well tools downhole. Such improvements may be useful for perforating, drilling, completing or other operations performed in wells.

DETAILED DESCRIPTION

Figure 1:
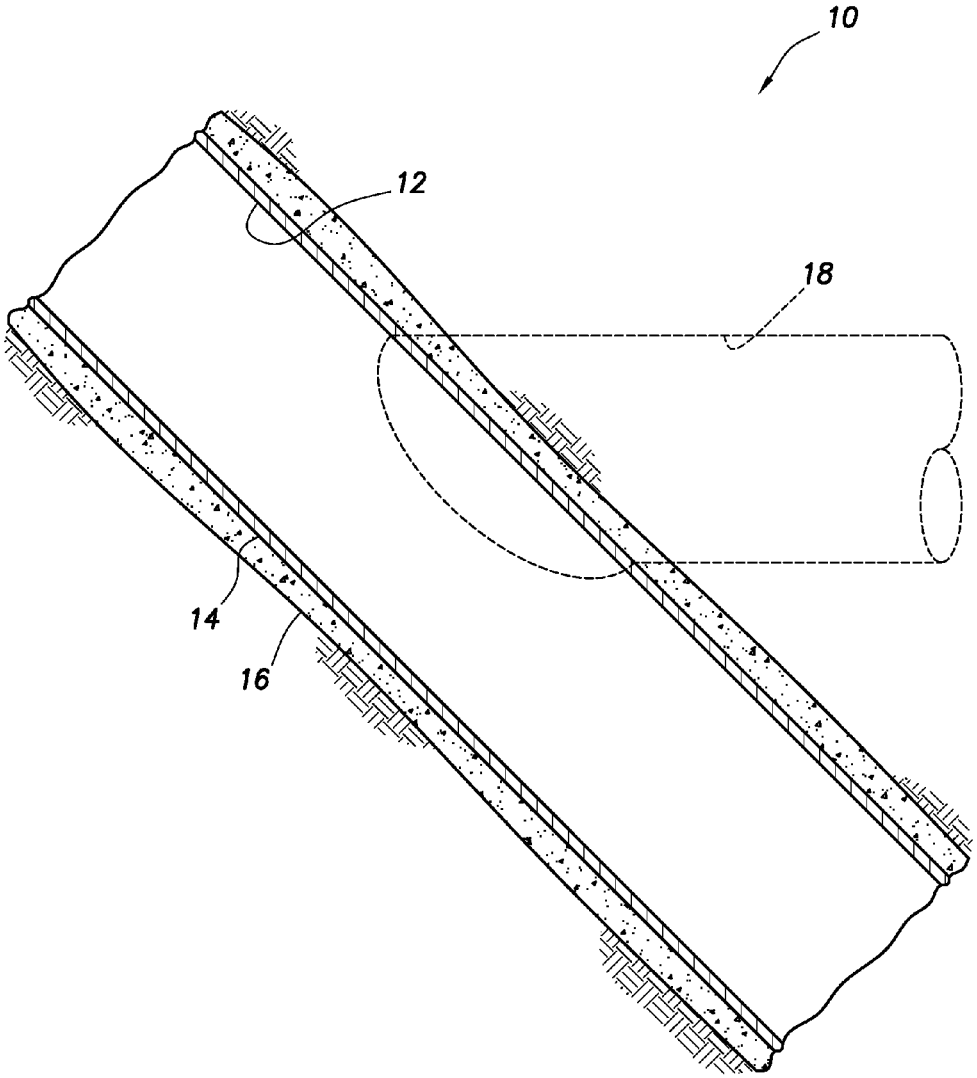
FIG. 1 is a representative cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled in the earth. A section of the wellbore 12 depicted in FIG. 1 is lined with casing 14 and cement 16. However, in other examples, the method could be performed in an uncased or open hole section of the wellbore 12.

The wellbore 12 section shown in FIG. 1 is deviated or inclined from vertical, so that the wellbore has an upper and a lower side. In other examples, the wellbore 12 section could be generally horizontal. Preferably, the wellbore 12 section in which the method is performed is not exactly vertical, although the wellbore could include other generally vertical sections.

It is desired, in this example, to drill a branch or lateral wellbore 18 extending outward from the upper side of the wellbore 12. In other examples, it might be desired to drill the lateral wellbore 18 from a lower side of the wellbore 12, or in other directions relative to the wellbore 12. Thus, the scope of this disclosure is not limited to orienting in any particular direction relative to a wellbore.

In addition, the scope of this disclosure is not limited to use with a lateral wellbore drilling operation. Instead, equipment and techniques described herein could be used for operations other than drilling, such as, perforating, completing, fracturing or other stimulating, etc.

Figure 2:
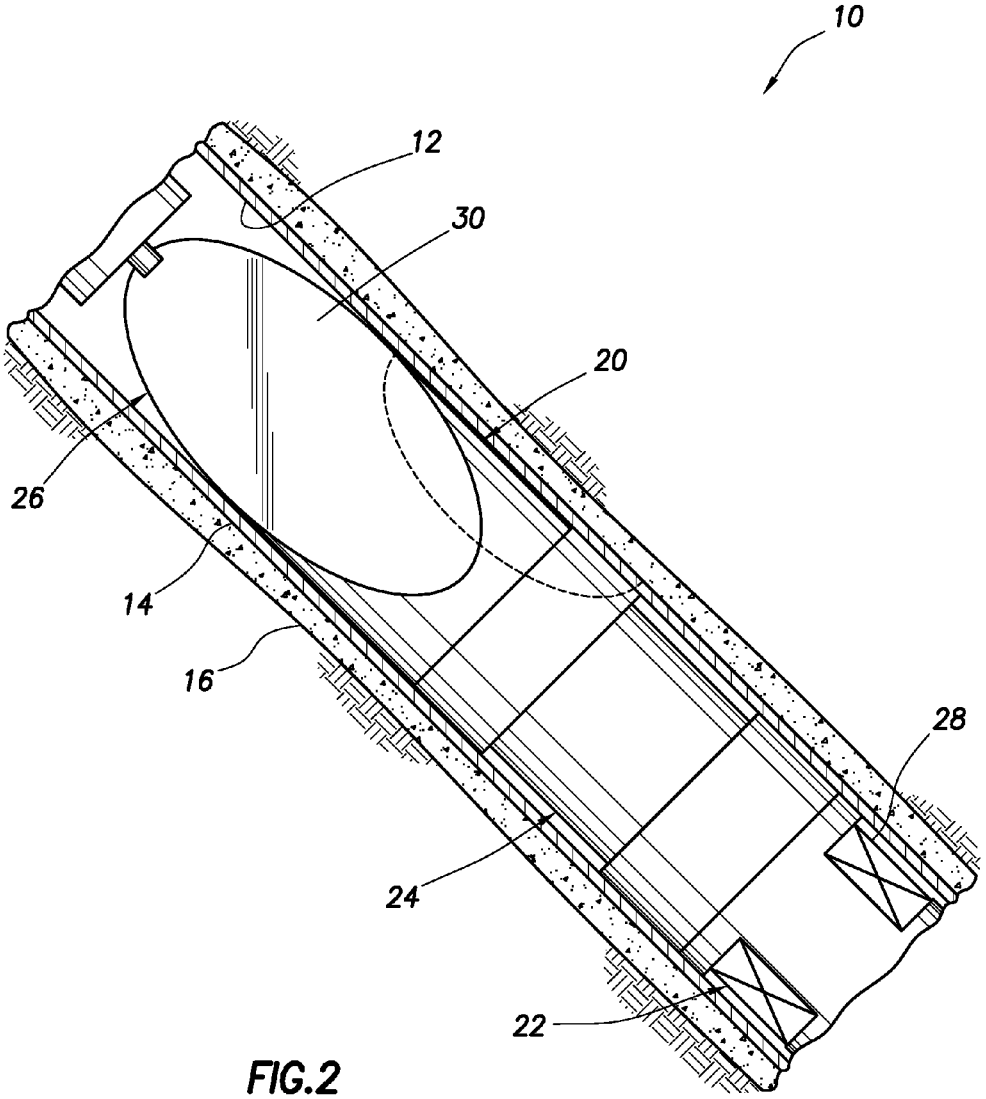
FIG. 2 is a representative partially cross-sectional view of the well system and method, in which a tool string has been introduced into a wellbore.

Referring additionally now to FIG. 2, the well system 10 and method are representatively illustrated after a tool string 20 has been introduced into the wellbore 12. In this example, the tool string 20 includes a packer 22, an orienting device 24 and a deflector 26.

The packer 22 includes an annular seal 28 for sealing engagement with an interior of the casing 14. The packer 22 can also include gripping devices, such as slips, for gripping the interior of the casing. The packer 22 is configured for sealing and securing the tool string 20 in the wellbore 12.

In other examples, the annular seal 28 may not be used. As another alternative, a latching device could be used to secure the tool string 20 in the wellbore 12, if desired. Thus, the scope of this disclosure is not limited to any particular element, or to any particular configuration, position, arrangement, number or types of elements, in the tool string 20.

The orienting device 24, in this example, is positioned between the packer 22 and the deflector 26. After the packer 22 is set, thereby securing the tool string 20 longitudinally in the wellbore 12, the orienting device 24 is used to rotationally or azimuthally orient the deflector 26 relative to the wellbore, so that the lateral wellbore 18 (see FIG. 1) is drilled in a desired direction relative to vertical from the wellbore 12.

The deflector 26 includes an inclined deflecting face 30. It is desired, in this example, to orient the face 30 toward the intended direction of drilling the lateral wellbore 18 (see FIG. 1).

It is further desired to accomplish this orientation at relatively low cost, without requiring use of complex logging tools, without requiring additional runs of equipment into the wellbore 12, and without requiring communication and/or cooperation between downhole equipment and surface instrumentation or personnel. However, some or all of these advantages may or may not obtained, without departing from the scope of this disclosure.

Figure 3:
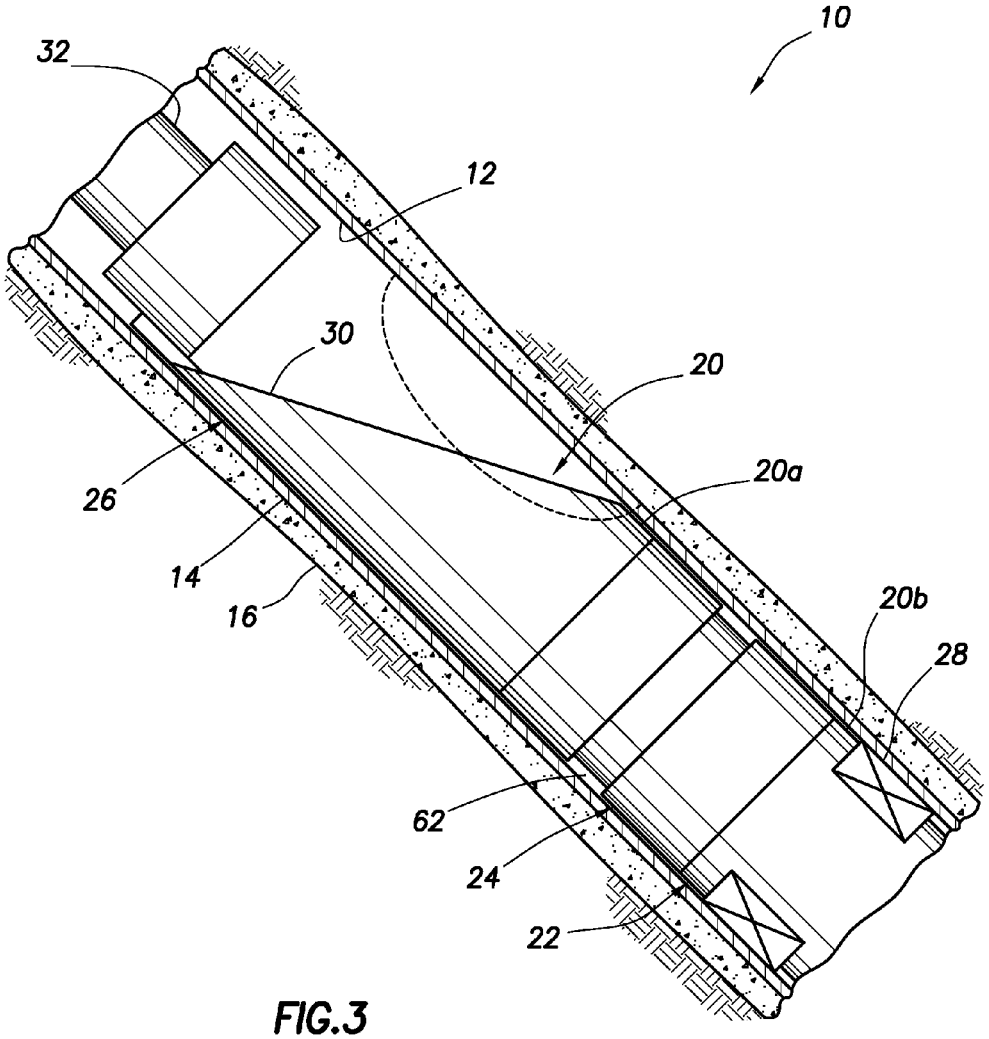
FIG. 3 is a representative partially cross-sectional view of the well system and method, in which a well tool in tool string has been rotationally or azimuthally oriented relative to the wellbore.

Referring additionally now to FIG. 3, the well system 10 and method is representatively illustrated after the deflector 26 has been oriented, so that the deflecting face 30 is directed toward the intended direction for drilling the lateral wellbore 18 (see FIG. 1). Note that a length of the orienting device 24 has decreased as the deflector 26 rotated to the desired orientation.

To accomplish the orienting of the deflector 26, the packer 22 is set (for example, by manipulation of the tool string 20 and/or by application of pressure to the tool string, etc.), thereby securing a lower section 20*b* of the tool string relative to the wellbore 12. Weight is then set down on an upper section 20*a* of the tool string 20 (for example, by slacking off on a work string 32 used to convey the tool string into the wellbore 12), so that the tool string is in compression.

This compression of the tool string 20 is used to rotate the deflector 26 to its desired orientation. Beneficially, the desired orientation relative to vertical, as well as the rotation of the deflector 26 to the desired orientation, are both accomplished with the compression applied to the tool string 20.

More specifically, in this example, the orienting device 24 is longitudinally compressed between the sections 20*a,b* of the tool string 20 on opposite sides of the orienting device. In the FIG. 3 example, an annular space 62 between components of the orienting device 24 is longitudinally decreased when the orienting device is compressed to orient the deflector 26.

Figure 4:
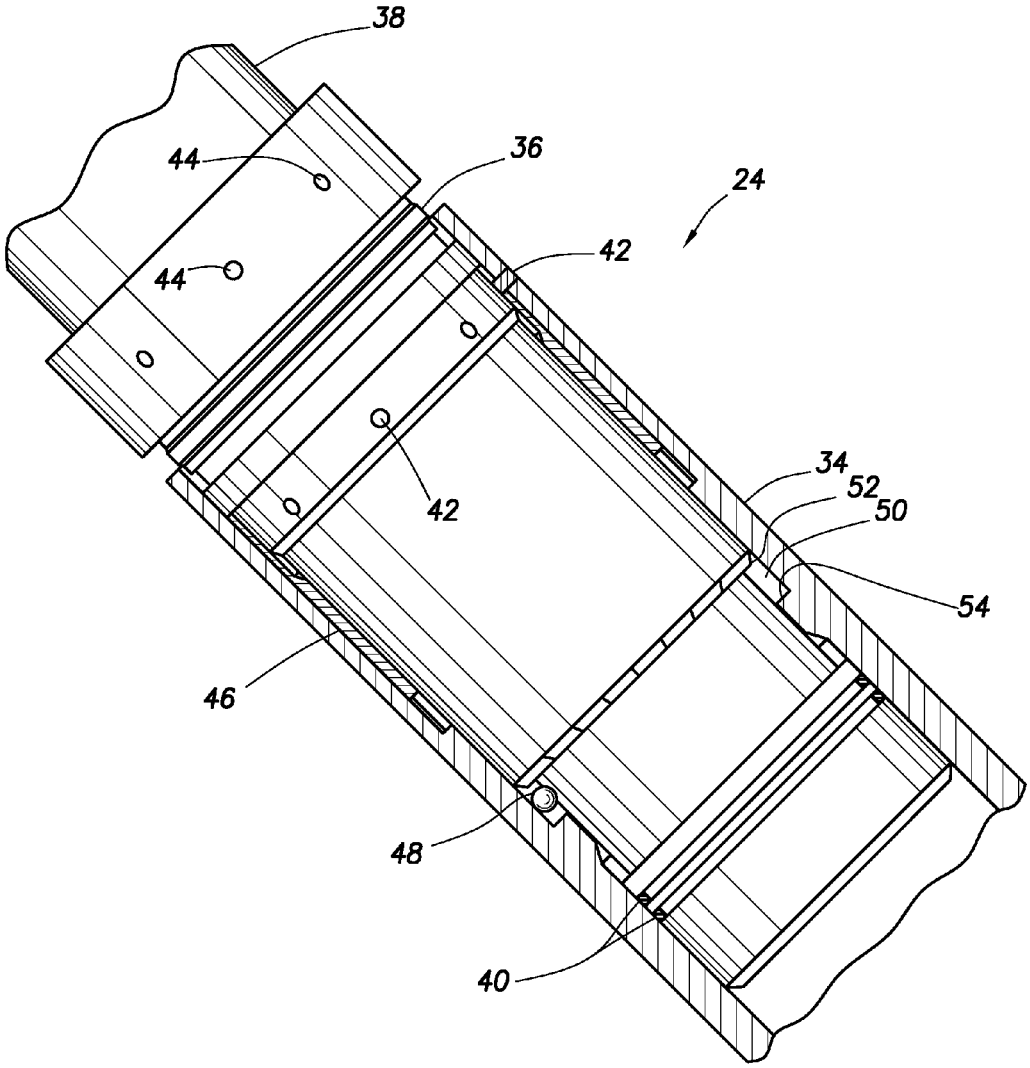
FIG. 4 is an enlarged scale representative partially cross-sectional view of an orienting device which may be used in the well system and method, and which can embody principles of this disclosure.

Referring additionally now to FIG. 4, an enlarged scale partially cross-sectional view of a portion of the orienting device 24 prior to the compression of the tool string 20 is representatively illustrated, apart from the remainder of the well system 10. Of course, the orienting device 24 can be used in other well systems and methods, in keeping with the principles of this disclosure.

In the FIG. 4 example, the orienting device 24 includes several generally tubular components arranged in a telescoping configuration. A first component comprises a generally tubular outer housing 34. A second component comprises a generally tubular sleeve 36 reciprocably received in an upper end of the housing 34. A third component comprises a generally tubular mandrel 38 reciprocably received in the housing 34 and sleeve 36. In this example, the mandrel 38 extends through the sleeve 36 and into the housing 34, wherein it is sealed by means of annular seals 40.

Releasable retainers 42 releasably secure the sleeve 36 relative to the housing 34, and similar releasable retainers 44 releasably secure the mandrel 38 relative to the sleeve 36. In the FIG. 4 example, the retainers 42, 44 are in the form of one or more shear pins, but in other examples, the retainers could have other forms (such as, one or more snap rings, shear rings, collets, latches, dogs, etc.). Thus, the scope of this disclosure is not limited to any particular configuration, components or elements of the orienting device 24 depicted in the drawings or described herein.

One or more longitudinally extending keys or splines 46 can be used to prevent relative rotation between the sleeve 36 and the housing 34, while permitting relative longitudinal displacement between the sleeve and housing. Note that longitudinal displacement of the sleeve 36 relative to the housing 34 is only permitted after the retainers 42 release, and longitudinal displacement of the mandrel 38 relative to the sleeve 36 is only permitted after the retainers 44 release.

If compression in the tool string 20 is used in setting the packer 22, then the retainers 42 may be configured to release at an applied compressive force greater than that used in setting the packer, so that the packer is set prior to the retainers releasing. The retainers 44 can be configured to release at an applied compressive force greater than that which causes the retainers 42 to release, so that the sleeve 36 longitudinally displaces relative to the housing 34 before the mandrel 38 longitudinally displaces relative to the sleeve.

An engagement member 48 is received in an annular space 50 formed radially between the housing 34 and the mandrel 38, and longitudinally between deformable structures 52, 54 on the sleeve 36 and housing 34, respectively. As depicted in FIG. 4 (prior to compression of the orienting device 24), the engagement member 48 is free to displace circumferentially in the annular space 50, so that the engagement member seeks, and generally remains in, a vertically lowermost portion of the annular space, due to the force of gravity.

Figure 5:
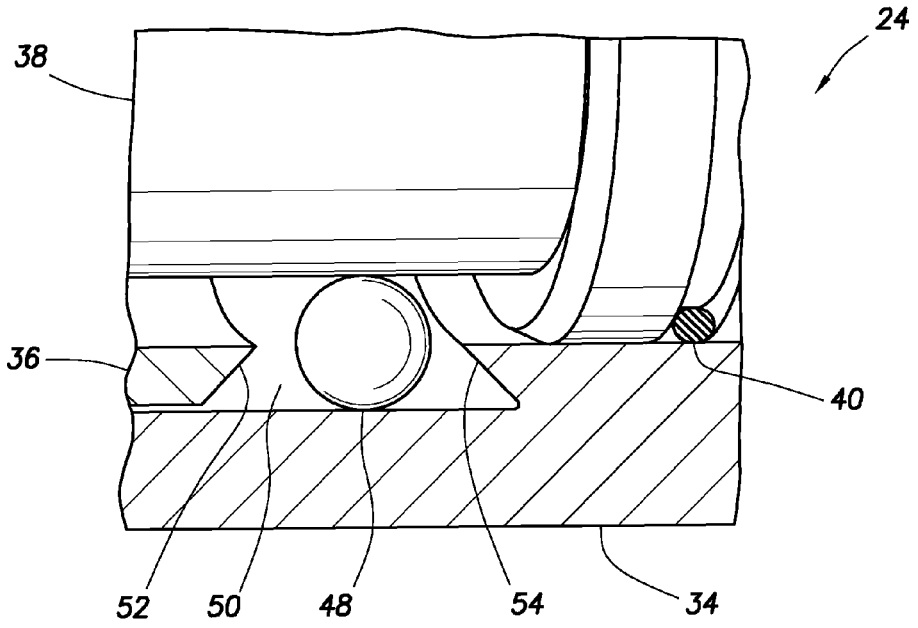
FIG. 5 is a further enlarged scale representative partially cross-sectional view of an engagement member positioned between structures of the orienting device.

Referring additionally now to FIG. 5, an enlarged scale partially cross-sectional view of a portion of the orienting device 24 is representatively illustrated. In this view, the manner in which the engagement member 48 is positioned with respect to the housing 34, sleeve 36, mandrel 38, annular space 50 and structures 52, 54 can be more clearly seen.

In this example, the engagement member 48 is in the form of a ball or sphere, and is capable of rolling circumferentially around in the annular space 50. In other examples, the engagement member 48 could have other shapes (such as, a cylinder shape, etc.). Thus, the scope of this disclosure is not limited to any particular shape of any components of the orienting device 24.

Note that the engagement member 48 projects radially inward more than does the sleeve 36 or the housing 34 (at least in this portion of the orienting device 24). In this manner, the engagement member 48 can engage an orienting profile (not visible in FIG. 5, see FIGS. 7 & 8) on the mandrel 38, as described more fully below.

Figure 6:
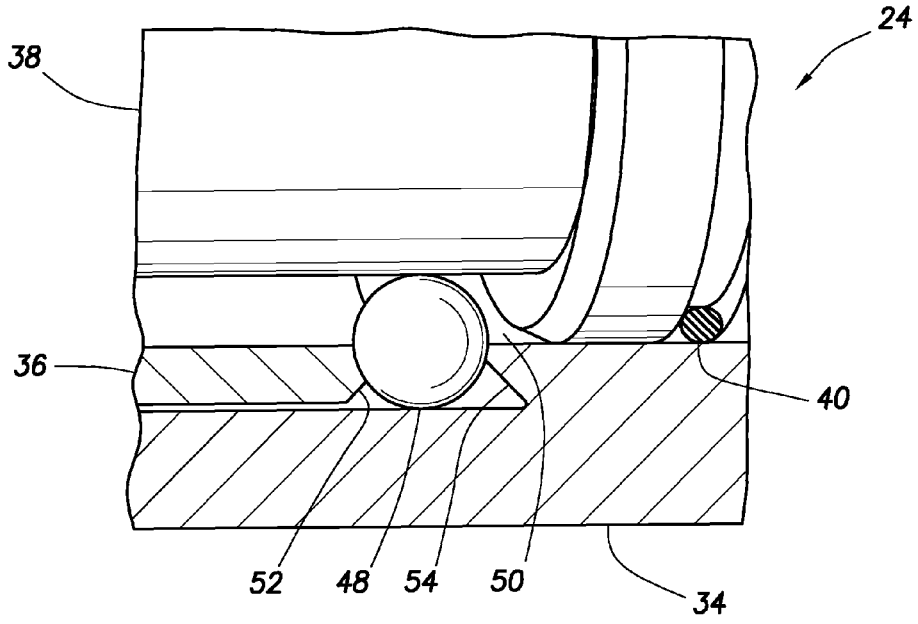
FIG. 6 is a representative partially cross-sectional view of the engagement member secured between the structures.

Referring additionally now to FIG. 6, the portion of the orienting device 24 depicted in FIG. 5 is representatively illustrated after sufficient compressive force has been applied to release the retainers 42 (see FIG. 4), after the packer 22 (see FIGS. 2 & 3) has been set. The release of the retainers 42 allows the sleeve 36 to displace longitudinally downward relative to the housing 34 (which is secured against longitudinal displacement by the packer 22).

Note that the annular space 50 is longitudinally decreased, due to the downward displacement of the sleeve 36 relative to the housing 34. The engagement member 48 is thereby longitudinally compressed between the structures 52, 54 on the sleeve 36 and the housing 34.

In the FIG. 6 example, both of the structures 52, 54 deform and thereby conform to the shape of the engagement member 48. In other examples, only one of the structures 52, 54 may deform, or neither of the structures may deform. However, the deformation of the structures 52, 54 can be used to secure the engagement member 48 in its vertically lowermost position in the annular space 50 after the retainers 42 have been released.

Whether or not the structures 52, 54 deform, the longitudinal compression of the engagement member 48 between the sleeve 36 and the housing 34 can be used to retain the engagement member, so that it has a known vertical position. The engagement member 48 can then be used to orient a well tool (such as the deflector 26) relative to vertical, since the engagement member has a known vertical position.

In the illustrated example, the structures 52, 54 are in the form of readily deformable longitudinally tapered shoulders formed on the sleeve 36 and housing 34. In other examples, the structures 52, 54 could be separate from the sleeve 36 and/or housing 34, the structures may not be tapered or otherwise thinned, the structures could be made of a readily deformable material, etc. Thus, the scope of this disclosure is not limited to any particular configuration or construction of the structures 52, 54.

Figure 7:
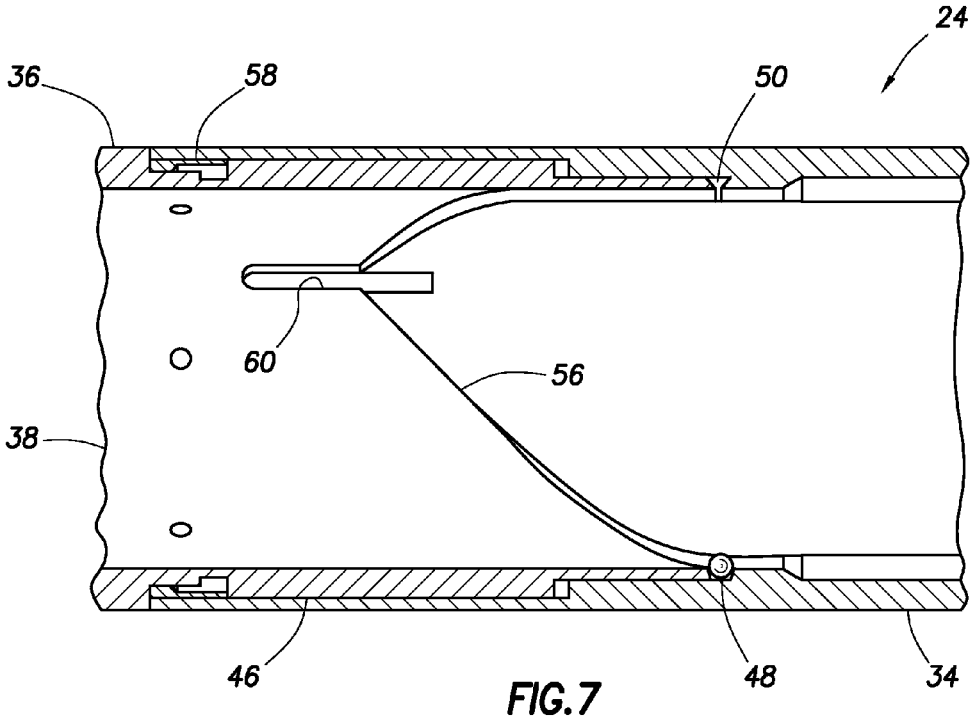
FIG. 7 is a representative partially cross-sectional view of an orienting profile of the orienting device engaged with the engagement member.

Referring additionally now to FIG. 7, a portion of the orienting device 24 is representatively illustrated after the retainers 44 have released. The engagement member 48 remains secured in its lowermost position in the space 50 between the sleeve 36 and the housing 34.

A locking device 58 prevents subsequent withdrawal of the sleeve 36 from the housing 34. In this example, the locking device 58 comprises a series of circumferentially distributed resilient locking fingers, but other types of locking devices (such as, snap rings, collets, locking dogs or latches, slips, etc.) may be used in other examples.

In addition, the mandrel 38 has partially displaced longitudinally downward (to the right as viewed in FIG. 7), so that an orienting profile 56 formed on the mandrel contacts the engagement member 48. As the mandrel 38 displaces downward, the contact between the engagement member 48 (which is secured in position) and the orienting profile 56 causes the mandrel 38 to rotate relative to the housing 34 and sleeve 36.

In the FIG. 7 example, the orienting profile 56 is in the form of two oppositely directed helical shoulders formed externally on the mandrel 38. This type of orienting profile is commonly known to those skilled in the art as a "muleshoe" profile. However, other types of orienting profiles may be used, if desired.

At an upper end (to the left as viewed in FIG. 7) of the orienting profile 56, where upper ends of the two helical shoulders meet, a longitudinally extending recess 60 is formed on the mandrel 38. The recess 60 has a known, fixed rotational or azimuthal orientation relative to the deflector 26 (or other well tool) connected above the orienting device 24.

For example, the orienting device 24 could be connected to the deflector 26 so that the recess 60 is rotationally opposite (180 degrees relative to) the deflecting face 30 of the deflector. As the mandrel 38 displaces downward and rotates (due to the contact between the engagement member 48 and the orienting profile 56), the deflector 26 will also rotate, so that the deflecting face 30 is eventually oriented toward the desired direction (in this example, vertically upward).

Figure 8:
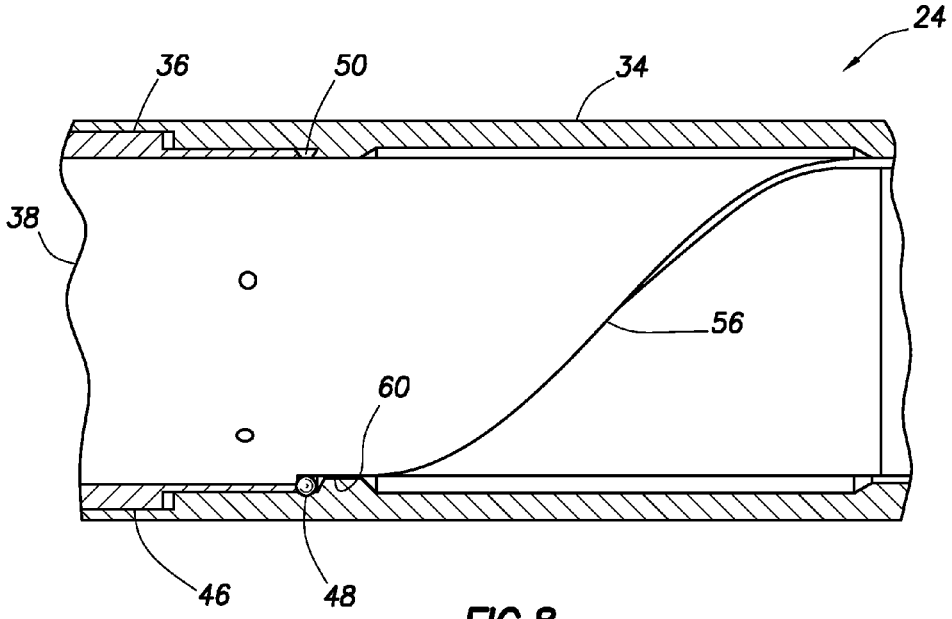
FIG. 8 is a representative partially cross-sectional view of the orienting profile displaced relative to the engagement member, causing rotation of a component of the orienting device.

Referring additionally now to FIG. 8, the orienting device 24 is representatively illustrated after the engagement member 48 has engaged the longitudinal recess 60. The deflector 26 (or other well tool) is now rotationally oriented in the desired direction (for example, as depicted in FIG. 3). Further downward displacement of the mandrel 38 relative to the housing 34 and sleeve 36 is prevented. A locking device (not shown) can be provided to prevent subsequent upward displacement of the mandrel 38 relative to the housing 34 and sleeve 36.

Although the description above has used orientation of the deflector 26 as one example, in order to provide an actual application for the principles of this disclosure, it should be clearly understood that those principles can be used in a variety of other applications. For example, a perforating gun, fluid sampler, camera, jetting tool or any other type of well tool can be rotationally or azimuthally oriented using the principles of this disclosure.

Although in the example described above, the desired orientation of the well tool is vertically upward, it should be clearly understood that well tools can be oriented in any desired direction using the principles of this disclosure. For example, the longitudinal recess 60 can be oriented relative to a feature of a well tool, so that the recess is opposite from (180 degrees relative to) or aligned with (0 degrees relative to) the feature, or at any other orientation (e.g., +/−90 degrees, +/−10 degrees, +/−50 degrees, etc.) relative to the feature.

It may now be fully appreciated that the above disclosure provides significant advancements to the art of orienting well tools downhole. The orienting device 24 example described above can conveniently rotationally orient a well tool, with only compression of the tool string 20 being used. No complex or expensive electronics, or means of communication between the device 24 and the surface, or separate trips into the well are needed (although these may be included, if desired).

In one aspect, a method of orienting a well tool (such as, the deflector 26) in a subterranean wellbore 12 is described above. In one example, the method comprises: setting down weight on an orienting device 24, thereby securing in position an engagement member 48 that was previously free to displace circumferentially in the device 24; and after the securing, engaging the engagement member 48 with an orienting profile 56.

The step of setting down weight may comprise compressing the orienting device 24 between sections 20*a,b* of the tool string 20.

The securing in position step can comprise deforming a structure 52, 54 of the orienting device 24. The deforming step can comprise conforming the structure 52, 54 to a shape of the engagement member 48.

The method can include after the securing step, compressing the orienting device 24 between sections 20*a,b* of the tool string 20, thereby orienting the well tool (such as, the deflector 26) relative to the wellbore 12. The orienting step can include the orienting profile 56 displacing with one of the sections 20*a* of the tool string 20 relative to the engagement member 48.

The securing step can include deforming a sleeve 36 that displaces during the step of setting down weight.

An orienting device 24 for use in a subterranean well is also described above. In one example, the orienting device 24 can include first and second releasable retainers 42, 44 which permit portions of the orienting device 24 to displace relative to one another in response to application of respective first and second compressive forces applied to the orienting device 24; an engagement member 48 free to displace circumferentially in the orienting device 24; and first and second components (such as, the housing 34 and the sleeve 36). A space 50 between the first and second components decreases in response to application of the first compressive force to the orienting device 24. The engagement member 48 is prevented from circumferential displacement in response to the decrease in the space 50 between the first and second components.

A locking device 58 may prevent an increase in the space 50 between the first and second components.

A length of the orienting device 24 may decrease in response to the decrease in the space 50 between the first and second components.

The orienting device 24 can also include a third component (such as, the mandrel 38). A space 62 (see FIG. 3) between the second and third components may decrease in response to application of the second compressive force.

An orienting profile 56 may displace relative to the engagement member 48 in response to the decrease in the space 62 between the second and third components. A length of the orienting device 24 may decrease in response to the decrease in the space 62 between the second and third components.

Another method of orienting a well tool in a subterranean wellbore 12 is described above. In one example, the method can comprise: compressing the orienting device 24 between sections 20*a,b* of a tool string 20, thereby securing in position an engagement member 48 that was previously free to displace circumferentially in the device 24, the securing step comprising deforming a structure 52, 54 of the orienting device 24; and after the securing, engaging the engagement member 48 with an orienting profile 56.

The compressing step can include setting down weight on the orienting device 24. The compressing step can include decreasing a length of the orienting device 24. Decreasing the length of the orienting device 24 may be performed (fully or partially) after the securing step, thereby orienting the well tool relative to the wellbore 12.

The orienting step can include the orienting profile 56 displacing with one of the sections 20*a,b* of the tool string 20 relative to the engagement member 48. The structure 52 may be on a sleeve 36 that displaces during the compressing step.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of orienting a well tool in a subterranean wellbore, the method comprising:

securing a lower portion of an orienting device relative to the wellbore;

setting down weight on the lower portion and an upper portion of the orienting device, thereby moving the upper portion relative to the lower portion and securing in position an engagement member that was previously free to displace circumferentially in the orienting device;

after the securing, engaging the engagement member with an orienting profile.

2. The method of claim 1, wherein the setting down weight comprises compressing the orienting device between sections of a tool string.

3. The method of claim 1, wherein the securing in position further comprises deforming a structure of the orienting device.

4. The method of claim 3, wherein the deforming further comprises conforming the structure to a shape of the engagement member.

5. The method of claim 1, further comprising, after the securing, compressing the orienting device between sections of a tool string, thereby orienting the well tool relative to the wellbore.

6. The method of claim 5, wherein the orienting further comprises the orienting profile displacing with one of the sections of the tool string relative to the engagement member.

7. The method of claim 1, wherein the securing further comprises deforming a sleeve that displaces during the setting down weight.

8. An orienting device for use in a subterranean well, the orienting device comprising:

a first component securable in the well;

a second component;

first releasable retainers configured to releasably secure the second component relative to the first component and release the second component upon application of a first compressive force applied to the first and second components;

an engagement member free to displace circumferentially in the orienting device before the second component is released; and wherein a space between the first and second components is decreased in response to application of the first compressive force; and wherein the engagement member is prevented from circumferential displacement by the decrease in the space between the first and second components.

9. The orienting device of claim 8, wherein a locking device is configured to prevent an increase in the space between the first and second components.

10. The orienting device of claim 8, wherein a length of the orienting device is decreased by the decrease in the space between the first and second components.

11. The orienting device of claim 8, further comprising:

a third component;

second releasable retainers configured to releasably secure the third component relative to the second component and release the third component upon application of a second compressive force applied to the orienting device; and wherein the third component is displaceable relative to the first and second components in response to application of the second compressive force.

12. The orienting device of claim 11, wherein an orienting profile is displaceable relative to the engagement member in response to the relative displacement between the second and third components.

13. The orienting device of claim 11, wherein a length of the orienting device decreases in response to the relative displacement between the second and third components.

14. A method of orienting a well tool in a subterranean wellbore, the method comprising:

securing a lower portion of an orienting device relative to the wellbore;

setting down weight on the lower portion and an upper portion of the orienting device, thereby compressing the orienting device between sections of a tool string, securing in position an engagement member previously free to displace circumferentially in the orienting device, deforming a structure of the orienting device; and after the securing, engaging the engagement member with an orienting profile.

15. The method of claim 14, wherein the compressing comprises setting down a weight on the orienting device.

16. The method of claim 14, wherein the deforming further comprises conforming the structure to a shape of the engagement member.

17. The method of claim 14, further comprising, after the securing, decreasing a length of the orienting device, thereby orienting the well tool relative to the wellbore.

18. The method of claim 17, wherein the orienting further comprises the orienting profile displacing with one of the sections of the tool string relative to the engagement member.

19. The method of claim 14, wherein the structure is on a sleeve that displaces during the compressing.

20. The method of claim 14, wherein the compressing further comprises decreasing a length of the orienting device.

* * * * *